US006789265B1

(12) United States Patent
Vonrinteln

(10) Patent No.: US 6,789,265 B1
(45) Date of Patent: Sep. 14, 2004

(54) BIB WITH SIDE POCKETS

(76) Inventor: Bonnie Vonrinteln, 821 Apple Ct., Marco Island, FL (US) 34145

( * ) Notice: Subject to any disclaimer, the term of this patent is extended or adjusted under 35 U.S.C. 154(b) by 0 days.

(21) Appl. No.: 10/457,956

(22) Filed: Jun. 10, 2003

(51) Int. Cl.[7] ..... A41B 13/10
(52) U.S. Cl. ..... 2/49.2; 2/48
(58) Field of Search ..... 2/48, 49.2, 49.1, 2/49.3, 49.4, 49.5, 50, 51, 52, 47, 46, 102, 104, 106, 114; D2/861, 863, 864

(56) References Cited

U.S. PATENT DOCUMENTS

D104,490 S * 5/1937 Anderson ..... D2/864
2,442,293 A * 5/1948 Hudson ..... 2/49.3
2,629,870 A * 2/1953 Hudson ..... 2/49.1
2,697,222 A * 12/1954 Reid ..... 2/49.2
D206,425 S * 12/1966 Faughnder ..... D2/864
4,233,688 A * 11/1980 Hjerl ..... 2/49.2
4,797,952 A * 1/1989 Petrini ..... 2/49.2
5,457,820 A * 10/1995 Yielding ..... 2/49.1
5,459,877 A * 10/1995 Roberti ..... 2/104
5,530,968 A * 7/1996 Crockett ..... 2/46
5,551,088 A * 9/1996 Stepp ..... 2/174
5,701,605 A * 12/1997 Bowen ..... 2/49.1
6,141,799 A * 11/2000 Morris ..... 2/52

* cited by examiner

*Primary Examiner*—A. Vanatta
(74) *Attorney, Agent, or Firm*—William F. Hamrock; William E. Noonan

(57) ABSTRACT

A disposable bib for protecting individuals primarily postured in a semi-reclined position, such as those in medical care settings. The bib includes a plastic body having a gathered neck opening, opposing forcefully open side catch pockets and an integrally joined transverse open bottom pocket. The bib is fabricated to provide concave body portion with rippling conduits which direct spillage into the pockets.

9 Claims, 4 Drawing Sheets

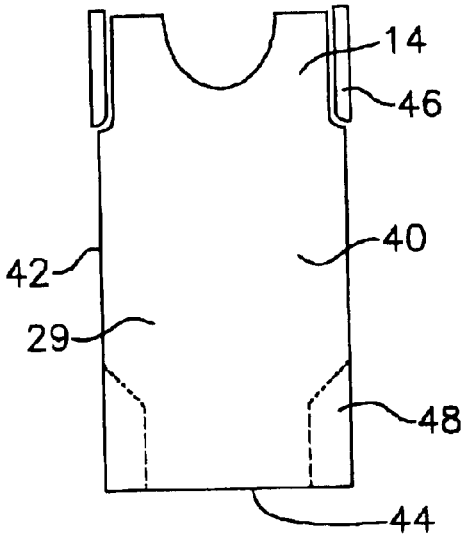
Fig. 3A
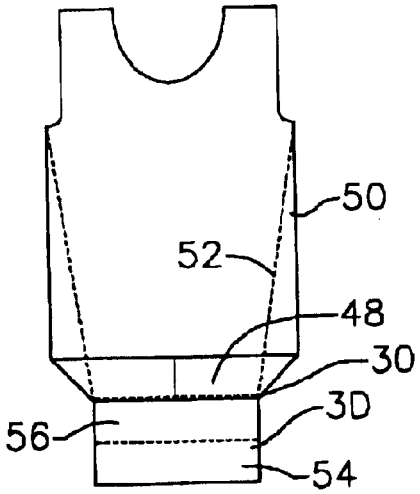
Fig. 3B
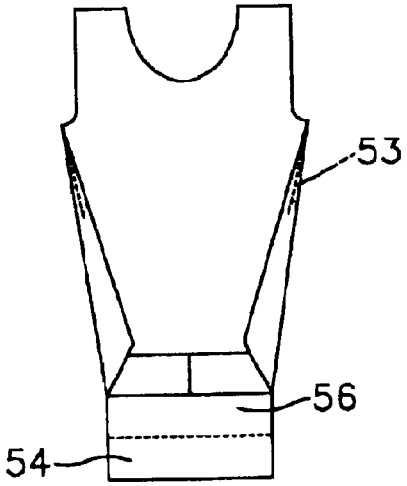
Fig. 3C
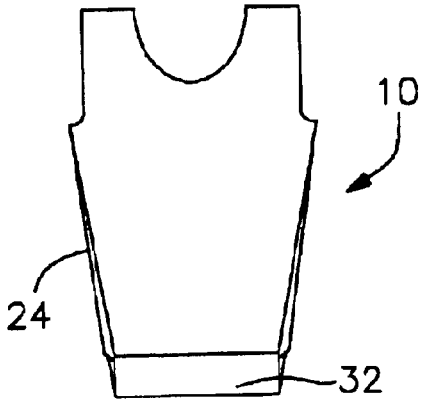
Fig. 3D
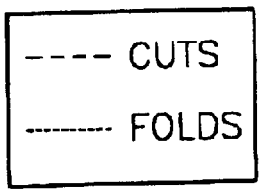

BIB WITH SIDE POCKETS

BACKGROUND OF THE INVENTION

The present invention relates to bibs, and in particular, to a disposable bib with torso side catch pockets, an improved bottom catch pocket and an improved neck opening directing the flow of matter into the pockets.

Based upon my experience as a Dietician wherein I have assisted in providing meals in medical care settings, there appears to be a serious problem with spillage when patients are served meals while in a semi-reclined position in a bed or special chair or other supporting device. Generally, bibs are used to meet the need of protecting the underlying garments of a wearer, be it a child or adult, from liquid or solid spills. Despite the multitude of bibs that are available, very few prove to be effective to protect the garments as well as the surrounding areas of the elderly, convalescing adults, and children from both liquid and solid spills during meal consumption, especially individuals in a medical care setting. Bedridden, convalescing, and handicapped individuals most often consume meals in a semi-reclined position from a bed or in a variety of specialized chairs. The meal is most often served on a tray placed on what is commonly known as a tray table. Most spillage for these individuals is due to poor control of eating utensils, poor body posture, and drooling which results in soiling of the neck and upper chest area. Use of most bibs in this setting appear to be only minimally effective when liquids and solids fall in the upper chest and neck area and gravitate down and to the sides. Thus, excessive soiling of garments as well as soiling of bedding, chairs, flooring and such remains a problem. Also, when excessive spills occur in medical care settings, they require an undesired increase in multiple care providers' time to clean the individual, change their garments, the bedding, and re-sanitize floor areas. Since there is limited health care funding, there is a need to help control health care costs by containing spillage during meal consumption.

Disposable bibs with and without pockets are in common use. Disposable bibs without pockets generally shield only the front of garments. They retain very limited amounts of liquid spills, most often in a semi-absorbent material. Since they do not have pockets, they fail to contain solid spills that gravitate downwardly and to the sides. Disposable bibs with bottom edge catch pockets make an attempt to catch both solids and liquids that gravitate downwardly, but quite often there is a problem in keeping the bottom catch pocket open to catch the spillage. Many bottom catch pockets are effective in a gravitational catch if the wearer is sitting upright at a 90 degree angle with the bib torso length, and the bib planar surface are such that a pocket of adequate width, depth, and height remains fixed in an open position precisely under the spill. Since many convalescing and other individuals must eat their meals while in a semi-reclined position, the amount of soiling of garments and surrounding dining areas remains to be a problem, as evidenced by the large number of various bibs made to solve this problem. Yet, while some advancements have been made in attempts to keep the bottom catch pocket open, they still fail to contain the gravitational upper chest side spills that often occur when an individual is consuming a meal in a semi-reclined position, such as those in medical care settings.

Furthermore, flat planar bib surfaces, with or without a catch pocket at the bottom edge, often become distorted on physically developed adults. This distorted surface area generally results in less frontal protective surface area for splashes whereas spills gravitate to the sides, soiling garments and surrounding areas.

A bib that offers a snug fit at the neck opening to protect from spillage and drooling is often desirous. Drooling is a common occurrence in many post-operative, post-stroke patients and the elderly. While snug fitting, the neck opening still needs to be adjustable to accommodate various neck sizes. Risk of choking then becomes a serious problem, but can be greatly reduced by the elimination of not only strings and ties around the neck, but by also eliminating other mechanisms of hook loop and fasteners. Loops that completely encircle the entire neck region, present a high risk of choking if they are pulled on. Similar problems are relative to complete closures around the neck area which are not desirous, such as for those with surgical sites, intravenous therapy, tracheas and such in the neck region.

It would appear that an inexpensive, disposable bib having an improved neck design, in combination with connected side and bottom catch pockets, would eliminate the need for well-known, more expensive multi-layered bibs. A proposed disposable bib having open side and open bottom pockets would catch and contain spills and thus would decrease manufacturing cost as opposed to the multi-layered bibs. Thus, it would appear that side pockets would be a needed improvement on disposable bibs to help catch and contain spills for those in semi-reclined and other positions for all of the reasons listed above.

Although some known bibs have external fastening devices to an exterior surface area to hold the bottom catch pocket open, they fail to provide any method for containing upper torso spills for a wearer in a semi-reclined position. It is known that bib lower catch pockets with attachment points to tables and chairs can be compromised with body movement. It would appear that if the bottom catch pocket could be held open in conjunction with adjoining open side pockets by means of a unique construction, it would give additional flexibility to the bib. This should provide freedom of movement generally, not previously available. Thus, it appears that open bilateral side catch pockets would be needed, in addition to an open bottom catch pocket to improve the intended function of the bib. Whereas the pockets on the right and left sides of the proposed invention allow for the patient's movement while maintaining the effect and holding capacity of the catch areas.

It does not appear that there is a bib with a neck design that provides means for directing spills and solids to a number of catch pockets. Also, it does not appear that there is a neck design in communication with bilateral open side pockets and an integrally open bottom catch pocket containment areas for spills to protect both the wearer's garments and their immediate surrounding area.

Accordingly, it is seen that a need remains for a bib which not only protects a wearer from spillage, but also collects the spilled food. In order to accomplish this, it is evident that there is a need in the art for an improved bib construction. Although there are a multitude of bibs available, it remains that they fail to catch and contain both solid and liquid spills for those persons in a semi-reclined position during meal consumption. No known bib overcomes the interworking dynamics of a semi-reclined person positioning and movement as does the proposed bib.

SUMMARY OF THE INVENTION

In accordance with the present invention, an improved disposable bib is provided that overcomes the deficiencies of prior art disposable bibs for protecting the garments and the surrounding areas of an individual in a semi-reclined position in a bed or while sitting in a specialized chair. The improved bib provides a sheet of flexible impervious material, adapted to overlie a frontal portion of the patient's torso. The flexible sheeting having upper and lower ends which can be made from a unitary blank. A bottom open catch pocket having a transverse opening extending the full width of the lower end adapted to catch spilled liquid and falling food. Opposing bilateral open side catch pockets extending downwardly on opposite sides of the sheeting integral with the bottom catch pocket are adapted to catch spilled liquid and food along the sides of the sheeting and to direct the material into the adjoined lower end open bottom catch pocket. Cut out U-shaped neck elements at the upper end of the sheeting are configured to fit under the chin and only around the front neck area of the patient. The neck elements gathered design provides means for directing the spillage into the opposing sides and the bottom catch pockets. The sheeting preferably can be formed from a unitary blank of thin flexible plastic wherein the opposing sides and the lower end can be folded inwardly to form open integral catch pockets whereas the upper end can be cut-out to form the neck elements.

BRIEF DESCRIPTION OF THE DRAWINGS

The invention is described by appended claims in relation to description of preferred embodiments with reference to the following drawings which are explained briefly as follows:

FIG. 3A is a view of a plastic blank showing cut-lines and fold lines.

FIG. 3B is a view showing initially forming side and bottom pockets.

FIG. 3C is a view showing initial creasing of side wall elements.

FIG. 3D is a view showing the formed bottom pocket integral with adjoined side walls.

DESCRIPTION OF THE PREFERRED EMBODIMENT

The present invention provides an inexpensive disposable thin plastic bib reliably attachable to a patient's clothing or pillow or other backing while the patient is reclining in a semi-reclined position. The present bib uniquely provides in combination, an improved contoured gathered neck design creating a concave plastic body surface providing conduits directing spilled liquids and solids into fixedly engaged open upper torso bilateral side catch pockets and integrally joined transverse bottom catch pocket.

Figure 1A:
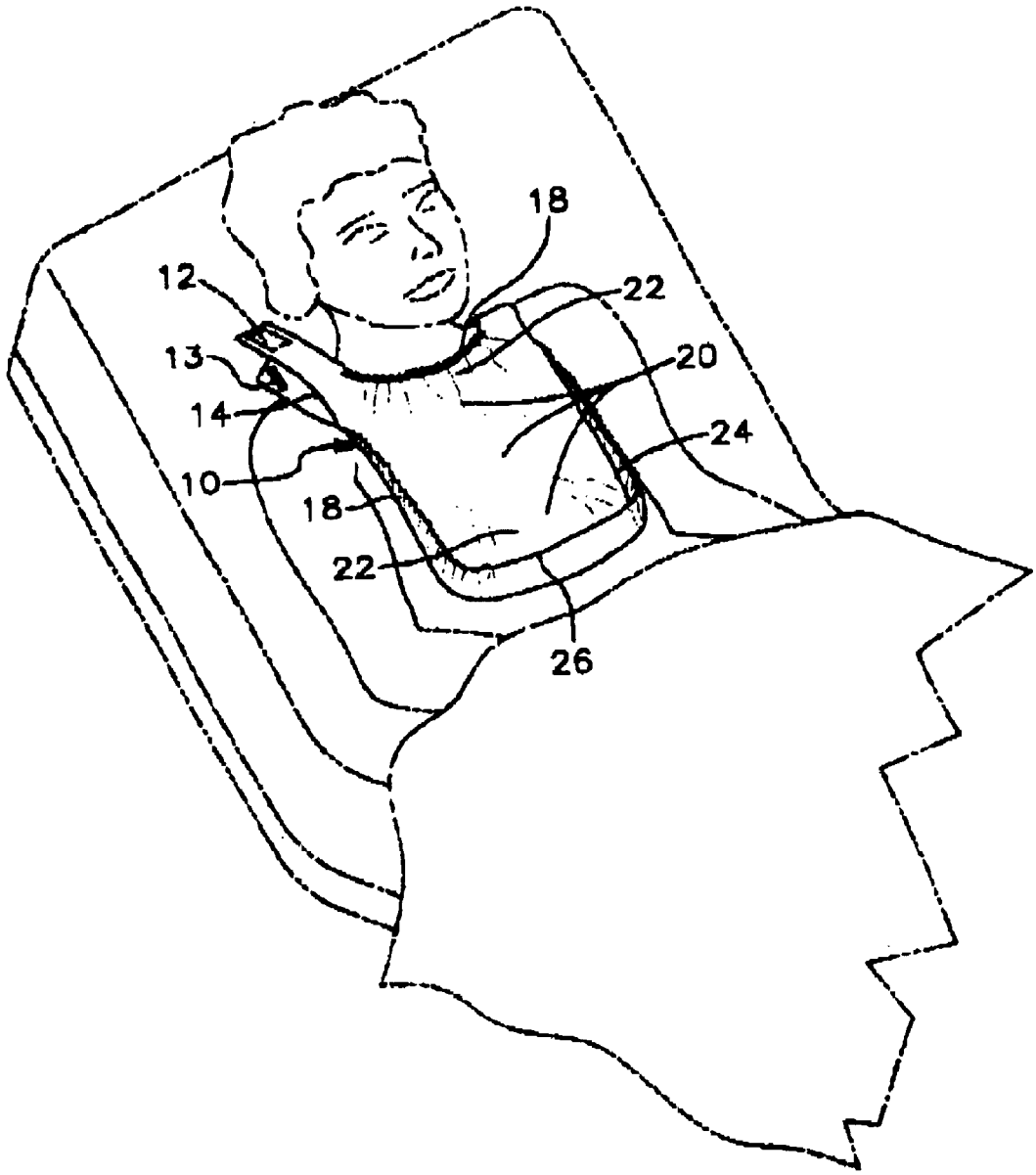
FIG. 1A is a front side elevational view of a patient in a semi-inclined position wearing a bib.

Referring to the drawings, FIG. 1A illustrates a preferred embodiment of the invention showing a patient reclining in a semi-reclined position wearing a bib 10. The bib is made from a liquid impervious material such as a thin plastic sheet, preferably polyethylene or similar thin impervious material. Commercial pressure sensitive adhesive tabs 12 or similar attachment are provided on opposite sides of shoulder elements 14 to adhere to the patient's clothing, pillow, bedding, chair or other backing. A peel-off backing may be used to preserve the adhesive until use.

Figure 1B:
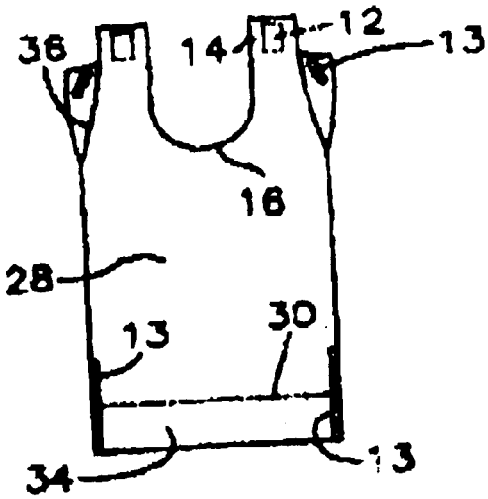
FIG. 1B is a view of a plastic sheet with fold lines for the bottom pocket.
Figure 1C:
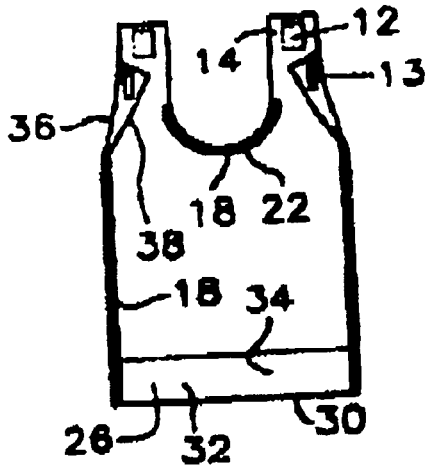
FIG. 1C is a view of the bottom pocket and gathering means at the neck and at the side pockets.

In a preferred embodiment depicted in FIG. 1A, the upper cut-out, arcuate shaped neck receiving portion 16 is contoured to fit under the chin and around the front of the neck, as shown. The periphery of neck portion 16 is encompassed by embedded gathering means 18, such as elastic or webbing, which encircles and pinches the rim creating a concave upper torso area 20 in the plastic body and multiple conduits 22 which direct the flow of spillage into side pockets 24 and integral transverse bottom pocket 26. Illustrated in FIGS. 1B and 1C is how flat plastic panel 28 is adapted to form the bib seen in FIG. 1A. Panel 28, as shown in FIG. 1B, includes cut-out neck 16, shoulder elements 14, adhesive tabs 12, flap tabs 13 and fold line 30. Opposing flap tabs 13 which are conventional adhesive tabs are located in the shoulder area and at opposing bottom side edges on either side of fold line 30. As seen in FIG. 1C, bottom pocket 26 is formed by turning upwardly bottom pocket front section 34 and adhering the opposing bonding flap tabs 13 together by thermal bonding, adhesive or similar means. Upper side pockets 38 are formed by folding inwardly upper side elements 36 and thermally or otherwise bonding by flap tabs 13. Gathering means 18, such as elastic or webbing, is embedded in the rim of neck cut-out 16, thereby crimping inwardly the attached plastic body forming a concave surface 20 having rippled conduits 22. Further gathering means are embedded lengthwise to the side edges of the opposing sides, crimping inwardly, forming crimped open side pockets 24 integral with and forcefully opening transverse bottom pocket 26. As seen with neck gathering means 18, the gathering means embedded in the side edges of side pockets 24 likewise form a concave 20 surface in the plastic sheet making substantially the entire surface concave with a multiple of conduits 22 directing the spillage into the pocket.

Figure 2A:
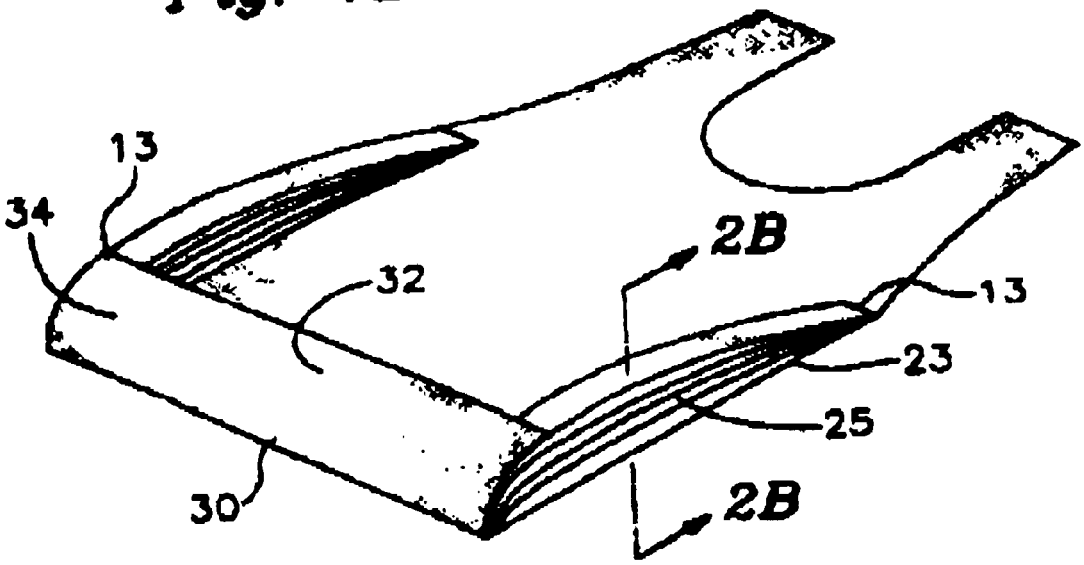
FIG. 2A is a side view showing the accordion configuration pockets integrally joined to the bottom pocket.
Figure 2B:
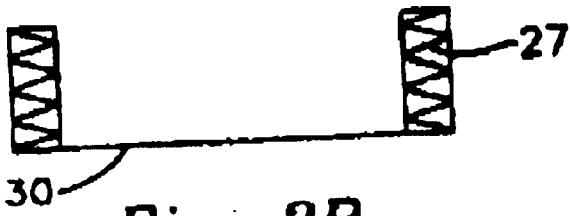
FIG. 2B is a fragmentary view illustrating the accordion side pockets.

Another preferred embodiment of the invention is shown in FIG. 2A. In this embodiment, opposing pleated side pockets 24 are prepared by first folding the bilateral side edges back and forth upon themselves providing accordion shaped side elements 25, as shown. The terminal ends of each accordion-shaped element are then adhered to the plastic sheet by adhesives, thermal bonding, or other adhering means. The opposing accordion side elements provide a multiple of V-segments 27, depicted in FIG. 2B fragmentary side view designed to expand the pleated pockets, thereby expanding the side pockets upwardly with overlapping open V-segments provided to catch and direct the spillage into an open bottom pocket. Bottom pocket 32 is formed by folding upwardly front panel 34 and adhering to the opposite side pockets by adhesives, thermal bonding, or similar adhering means. Bottom pocket 32 is secured to the accordion side pockets in a substantially locked, open position by being integrally joined thereto.

A further preferred embodiment providing side pockets and adjoining transverse bottom pocket is best described in FIGS. 3A to 3D. As seen in FIG. 3A, bib blank 29 includes an elongated rectangular sheet 40 with lengthwise side edges 42 and longitudinal bottom edge 44. Shoulder elements 14 are formed by discarding top side remnants 46. Opposing bottom tab elements 48, shown in FIG. 3B, fold inwardly to the midpoint of sheet 40 as the initial step in forming the bottom pocket. Forming the side pockets is depicted in FIGS. 3B through 3C. Opposing side pocket elements 50 are folded upwardly along fold lines 52 and creased inwardly at crease and attached at line 53, creating expanded V-configured side elements. The side pocket elements are integrally joined with the bottom pocket by folding elements 56 and 54 upwardly along fold lines 30 to overlap element 48. The bottom pocket and lower side elements 50 are interconnected and reinforced by bottom element 54 extending over interior bottom element 48 and lower side elements 50.

Figure 4A:
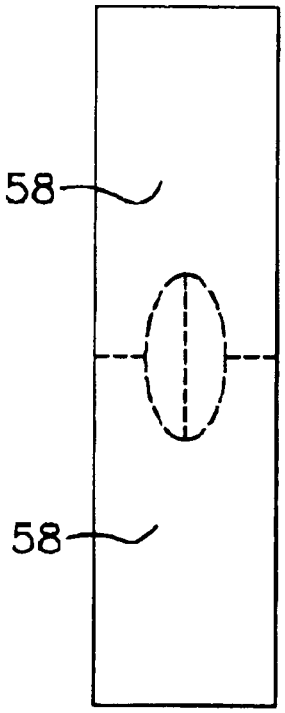
FIG. 4A is a view showing joined plastic blanks.
Figure 4B:
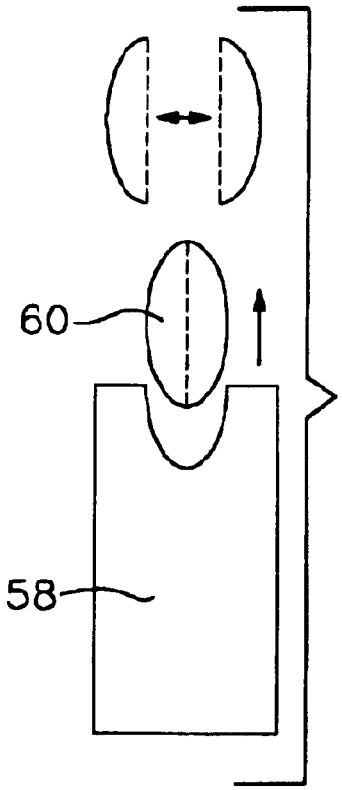
FIG. 4B is an exploded view of the remnants.
Figure 4C:
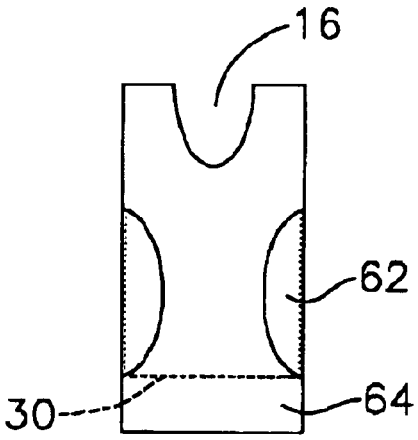
FIG. 4C is a view of joined arcuate side remnants.
Figure 4D:
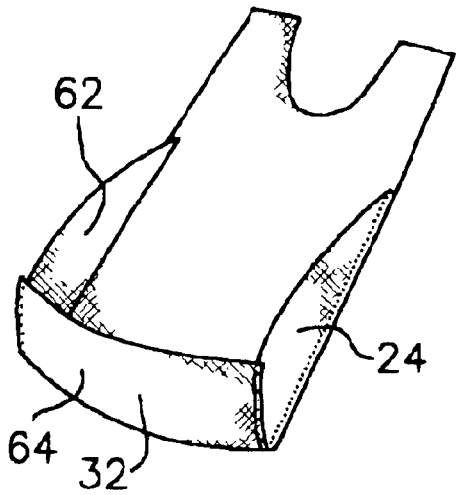
FIG. 4D is a view of the side pockets integrally joined with the bottom pocket.

As depicted in FIGS. 4A to 4D, the bib is illustrated being fabricated from adjoining plastic blanks 58, generally removed from a plastic roll, not shown. In this embodiment, arcuate-shaped remnants 62 are cut lengthwise from neck remnants 60, cut from adjoining plastic blanks 58. The arcuate-shaped remnants are adhered to opposing side edges of the blank as seen in FIG. 4C. Bottom panel 64 is folded upwardly through fold lines 30 and secured to the lower edges of arcuate-shaped remnants 62 by adhering means forming side pockets 24 and bottom pocket 32 as shown in FIG. 4D. Attachments of gathering means embedded in the cut-out neck and side pockets, as previously described, enhance the formation of the concave plastic body area, thereby directing the spillage into the side pockets and bottom pocket.

While the above descriptions and drawings are specific to the preferred embodiments, it will readily be seen that many other variations of the invention within the scope of the appended claims will be apparent to those skilled in the art once the principles described herein are understood.

What is claimed is:

1. A disposable bib protecting against spillage to the upper front torso of a wearer reclining in an inclined position at about a forty five degree angle, said bib comprising a thin flexible plastic sheet having a top, a bottom and opposing side edges providing an upper neck portion and lower body portion for protecting the upper front torso, the upper neck portion including a U-shaped neck opening having a front arcuate neck opening embedded with a gathering means crimping inwardly forming a concave adjacent body surface portion providing conduit channels therein, and opposing shoulder elements extending upwardly adjacent to the U-shaped neck opening with flap tabs mounted on opposing inwardly folded upper side edges attaching to the shoulder elements forming opposing side upper pockets, the lower portion including opposing lower side pockets extending downwardly on each opposite side, and a transverse bottom pocket extending transversely across the bottom integrally coupling with the opposing lower side pockets, the lower side and bottom pockets being pressurized in open positions.

2. The disposable bib according to claim 1 wherein the plastic sheet has a substantially rectangular configuration.

3. The disposable bib according to claim 1 wherein adhesive tabs mounted on the shoulder elements are releasably attachable to a separate backing.

4. The disposable bib according to claim 1 wherein flap tabs mounted above and below side edges on opposite sides of a bottom body fold line are adhered together in forming the bottom pocket.

5. The disposable bib according to claim 3 wherein flap tabs mounted above and below side edges on opposite sides of a bottom body fold line on the sheet are adhered together in forming the bottom pocket.

6. The disposable bib according to claim 5 wherein gathering means are embedded in the arcuate front neck opening crimping inwardly forming the concave adjacent body surface and the conduit channels directing spillage into the pockets.

7. The disposable bib according to claim 6 wherein further gathering means are embedded into the opposing side edges extending downwardly into the bottom pocket.

8. The disposable bib according to claim 7 wherein the further gathering means crimp inwardly forcefully forming open side pockets and forcefully open the bottom pocket.

9. The disposable bib according to claim 8 wherein the further gathering means comprise elastic or webbing.

* * * * *